US006033303A

United States Patent [19]

Green et al.

[11] Patent Number: 6,033,303

[45] Date of Patent: Mar. 7, 2000

[54] TERTIARY DUST CONTROL PROCESS AND SYSTEM FOR USE IN THE MACHINE ROOM OF A PAPERMAKING PLANT

[75] Inventors: Kevin S. Green, Hamilton, Ohio; S. Edward Botterill, Thunder Bay, Canada

[73] Assignee: Valmet, Inc., Charlotte, N.C.

[21] Appl. No.: 09/093,278

[22] Filed: Jun. 8, 1998

[51] Int. Cl.[7] ..... F24F 7/007

[52] U.S. Cl. ..... 454/252; 454/49

[58] Field of Search ..... 454/49, 252, 253

[56] References Cited

U.S. PATENT DOCUMENTS

| | | | |
|---|---|---|---|
| 242,264 | 5/1881 | Bullymore | 454/253 |
| 1,841,957 | 1/1932 | Kelly | 454/253 |
| 4,460,389 | 7/1984 | Baum et al. | 454/49 X |
| 5,314,376 | 5/1994 | Kuramarohit | 454/186 |
| 5,791,983 | 8/1998 | Robertson | 454/252 X |

FOREIGN PATENT DOCUMENTS

| | | | |
|---|---|---|---|
| 1502912 | 8/1989 | U.S.S.R. | 454/49 |

*Primary Examiner*—Harold Joyce
*Attorney, Agent, or Firm*—Michael E. McKee

[57] ABSTRACT

A process and system (60) for controlling the concentration of dust levels in a room (20) within which a paper-making, or finishing, machine (24) is housed involves a ventilation scheme which withdraws air from the room by way of ceiling vents (52) disposed generally above the tissue-making machine and directs fresh air into the room by way of inlet displacement modules (64) located adjacent the walls of the room which creates a moving wall of fresh air through the room. The flow of air being withdrawn from the room is coordinated with the flow of fresh air directed into the room so that a controlled air migration pattern is established and so that the fresh air displaces, rather than is diluted by, the room air. Along with this flow of room air, heat and humidity-generating vapors which are released by the tissue-making machine during operation are also pushed out of the room through the ceiling vents ahead of the fresh air. Consequently, areas surrounding the tissue-making machine at which machine operators are expected to work are appreciably free of dust, heat and vapors released by the tissue-making machine.

11 Claims, 5 Drawing Sheets

TERTIARY DUST CONTROL PROCESS AND SYSTEM FOR USE IN THE MACHINE ROOM OF A PAPERMAKING PLANT

BACKGROUND OF INVENTION

This invention relates generally to the controlling of dust concentration levels in a room within which dust-releasing equipment is housed and relates, more particularly, to the means and methods for controlling the concentration levels of respirable dust in a machine room within which a papermaking machine is housed.

The processes and systems with which this invention is to be compared include those used for ventilating the environment of a room within which dust is generated and within which operators are expected to work. In a room in which a papermaking machine is used for making tissue, for example, a relatively large amount of dust (including cellulose fiber, clay, starch and other chemical dust) is released into the surrounding air by the papermaking process, and this dust can create operating hazards, worker health hazards, and is likely to migrate to various areas of the room and create a cleanliness (e.g. machine hygiene) problem or increase the risk of fire at those areas.

Heretofore, attempts to control the amount of dust released into a papermaking machine room involve the capturing of dust at the source of creation (referred to herein as primary dust control) and the containing of dust adjacent the source of dust creation (referred to herein as secondary dust control). Primary dust control systems can include equipment known in the art as "on sheet" dust collectors or any equipment designed to remove dust from its point of generation, and secondary dust control schemes can include canopy hoods, area dust collectors, winder enclosures and specially-designed air curtain systems for containing dust near its point of generation. However, no primary and secondary dust control systems are totally effective in preventing the release of all unwanted dust into the environment of a machine room.

Conventional schemes used for ventilating a papermaking room commonly involve the ventilating of the room so that fresh air continually replenishes the air surrounding the machine into which dust is released. However, the fresh air which is introduced into the room in accordance with these conventional schemes is normally introduced therein at a relatively high velocity and in such a manner that regions of air within the room are "entrained" by the flow of fresh air, and this entrainment of air establishes uncontrolled reverse migration air flow patterns which result in a mass dilution, or mixing, of the fresh air with dust-laden air in the room. Consequently, the likelihood is high with these conventional room-ventilation schemes that few, if any, locations will exist within the room which is appreciably free from some degree of dust and that dust-laden air will be present in areas of the room where it could be breathed by operators. To protect operators who work in such papermaking machine environments, governmental regulations have been established which require that the concentration levels of respirable dust in a room be maintained below prescribed levels.

In addition to the release of dust, a papermaking process also releases a relatively large amount of heat and humidity-creating vapor into the surrounding air. Of course, inasmuch as common room-ventilating schemes mix incoming fresh air with dust-carrying air, the heat and humidity-creating vapors released by the papermaking process are mixed with the fresh air, as well. Prior art (i.e. conventional) air systems can therefore lead to uncontrolled and uneven temperatures and humidity areas within the machine room.

It is an object of the present invention to provide a new and improved process and system for ventilating the room within which dust-releasing equipment is located.

Another object of the present invention is to provide such a process and system for reducing the concentration levels of dust in areas adjacent the dust-releasing equipment.

Still another object of the present invention is to provide such a process and system whose operation controls the migration pattern of dust-carrying air through the room so that fresh air which is directed into the environment of the room displaces, rather than is diluted by, the dust-carrying air in the room.

Yet another object of the present invention is to provide such a process and system which is particularly well-suited for use in a room within which a papermaking machine, such as a tissue-making machine, is housed for limiting the concentration levels of dust in areas of the room adjacent the tissue-making machine and controlling the concentration levels of heat and vapors which are released by the tissue-making machine during operation.

SUMMARY OF THE INVENTION

This invention resides in a process and system for for ventilating a room bounded by walls, a ceiling and a floor and wherein a dust-releasing source, such as a tissue-making machine, is positioned substantially centrally of the floor of the room and the air which surrounds the dust-releasing source carries dust released therefrom.

The process of the invention includes the steps of introducing fresh, substantially dust-free air into the room through locations along the walls so that the introduced fresh air is directed generally away from the wall locations in a flow pattern which prevents air from moving generally from the center of the room toward the wall locations and withdrawing air from the room through the ceiling at locations therein disposed generally above the dust-releasing source. In addition, the introduction of fresh air into the room and the withdrawal of air from the room are coordinated so that substantially all of the dust-carrying air surrounding the dust-releasing source is moved by the introduced fresh air generally upwardly toward the ceiling locations through which the air is withdrawn from the room and is substantially displaced within the room by the introduced fresh air.

The system of the invention includes means for carrying out the steps of the process of the invention. More specifically, the system includes means for introducing fresh, substantially dust-free air into the room through inlet locations adjacent the room walls so that air which is introduced through said inlet locations is directed away therefrom in a flow pattern which generally prevents air from moving from the center of the room toward said inlet locations and means for withdrawing air from the room through the ceiling by way of vents provided therein at locations disposed generally above the dust-releasing source. Furthermore, the introducing means and withdrawing means are coordinated with one another so that substantially all of the dust-carrying air which surrounds the dust-releasing source is moved generally upwardly through the room toward the ceiling vents by the introduced fresh air and is substantially displaced in the room by the introduced fresh air.

In addition to its dust-limiting capabilities, the system of the invention also provides a marked improvement over room ventilation schemes of the prior art with respect to the control of heat and humidity-creating vapors which are released by the papermaking machine during operation. In other words, since released heat and humidity-creating vapors can add to heat stress levels that adversely affect motor and neurological skills of operators attending the papermaking machine, the capacity of the system of the present invention to control the released heat and vapors renders the system advantageous in this respect.

DETAILED DESCRIPTION OF AN ILLUSTRATIVE EMBODIMENT

Figure 1:
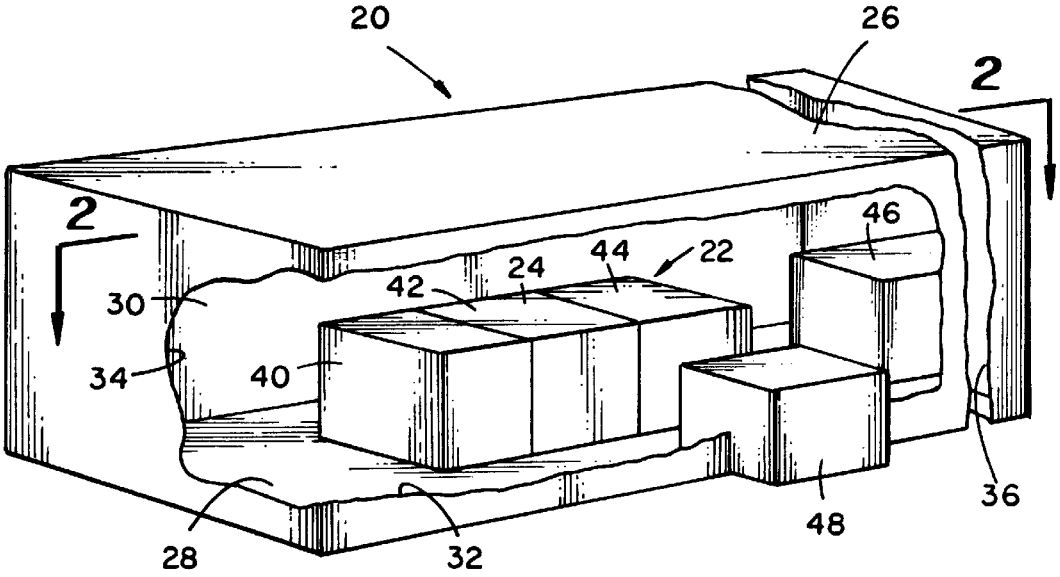
FIG. 1 is a perspective view, shown partially cut-away, of a fragment of a papermaking machine room, shown without a mezzanine, and which illustrates schematically the relative positioning of the various equipment located within the room.
Figure 2:
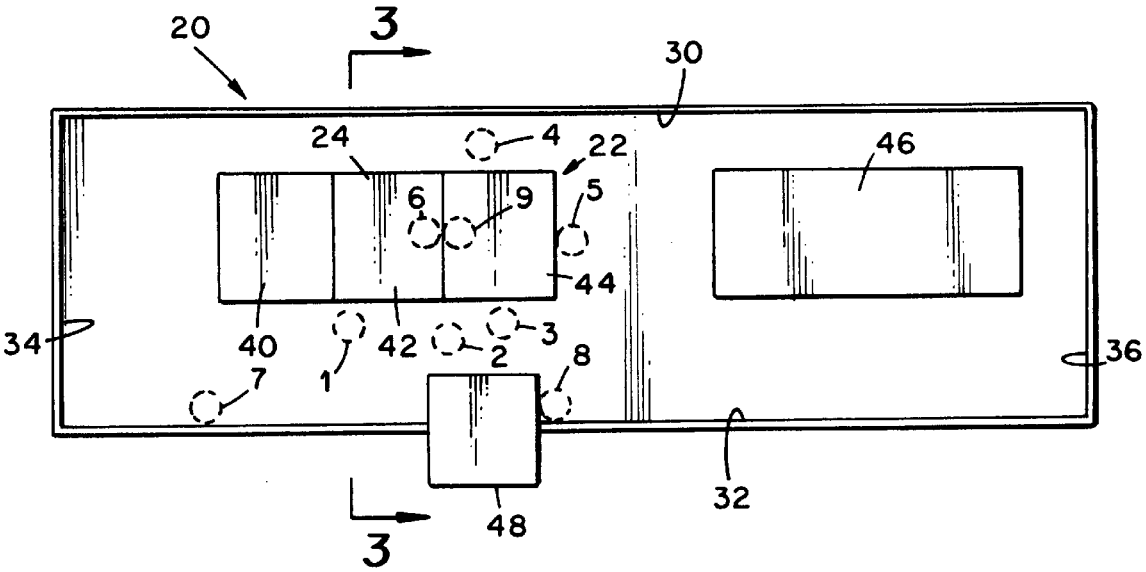
FIG. 2 is a plan view of the room of FIG. 1, as viewed along line 2—2 of FIG. 1.

Turning now to the drawings in greater detail, there is schematically shown in FIGS. 1 and 2 a machine room, generally indicated 20, within which a dust-releasing source, generally indicated 22, is housed and which is capable of being ventilated by the process and system of the present invention. More specifically, the room 20 depicted in FIGS. 1 and 2 is a room of a papermaking plant, and the dust-generating source 22 is a tissue-making machine (hereinafter tissue machine) 24 used for making tissue paper. The room 20 is substantially box-like in form and is bounded by a ceiling 26, a floor 28 and walls comprising two opposing sidewalls 30, 32 and two opposing endwalls 34, 36. A mezzanine 38 (shown only in FIGS. 3 and 4) extends along the length of one sidewall 32. The depicted room 20 is elongated in form with its sidewalls 30, 32 being longer than either of its endwalls 34, 36.

As do many conventional tissue machines, the tissue machine 24 of FIGS. 1 and 2 includes operating equipment stationed at a wet end 40, a dryer section 42 and a reel section 44 which are arranged in sequence along the floor 28 and positioned substantially centrally of the room 20. It will be understood, however, that even though the machine 24 (as is the case within the FIG. 1 room 20) is positioned closer to one sidewall 30 than to the other sidewall 32, the machine 24 is positioned "substantially centrally" of the room as long as the machine 24 is spaced inwardly from the room sidewalls 30, 32 and endwalls 34, 36. Also housed within the room 20 is a finishing section 46 which is spaced from the reel section 44 on the end of the machine 24 closest to the endwall 36, and a control room 48 is incorporated within one sidewall 32 and positioned adjacent the reel section 44. Since not all tissue machine rooms house all of the aforementioned pieces of equipment such as the aforementioned finishing section 46, it will be understood that the use of the system and process described herein is not limited to machine rooms which include all of the aforementioned pieces of equipment.

During operation of the tissue machine 24, dust comprised, for example, of including cellulose fiber, clay, starch and other chemical dust is likely to be released at any of the aforementioned wet end 40, dryer section 42 and dryer section 44 and escape into the respirable air of the room 20. Although not considered to be as hazardous to health as dust, vapors (i.e. water vapor) and thermal energy (i.e. heat) are also released by the tissue machine equipment during operation. As will be apparent herein, the natural movement of the released vapors and heat during operation of the tissue machine 24 aids the process of the invention described herein for ventilating the room 24.

In order to operate and service the equipment of the tissue machine 24, human operators must occasionally stand and move about the various components of the machine 24. From a health and safety standpoint, it is desirable that the air in which these operators must work be as substantially dust-free as is possible to reduce the amount of dust breathed by the operators. The dust concentration level in air at a location is monitored by gravimetric samplers during normal operating conditions, and the results are measured in milligrams per cubic meter (i.e. $mg/m^3$). To obtain a time-weighted average of the dust concentration level at a location (and thereby obtain a better indication of the exposure to an operator over time), measurements are taken with the samplers over an eight-hour period and averaged. Exemplary stations at which sample measurements are taken are indicated in FIG. 2 at stations indicated 1–9. With the exception of station 9, measurements are preferably taken at each station at a location approximately 1.5 meters from the floor 28 corresponding to the height from the floor 28 from which air is normally inhaled by an operator. Station 9 is a location disposed centrally beneath the paper sheet being routed through the machine 24 and is believed to be a location at which the release of dust from the papermaking process is the greatest. The dust concentration measurement obtained at station 9 therefore provides a reference measurement against which the measurements obtained at stations 1–8 can be compared. As will be apparent herein, the ventilation process and system of the present invention renders the concentration level of dust at the exemplary stations 1–8 very low.

To reduce the amount of dust which is released from the machine 24 into the surrounding air, the machine 24 is preferably equipped with primary and secondary dust control apparatus. The primary dust control apparatus (intended to capture dust at the source) may take the form of equipment known in the art as "on-sheet" dust collectors. The secondary dust control apparatus may take the form of equipment known in the art as canopy hoods, area dust collectors, area dust collectors, winder enclosures and specially-designed air curtain systems. However, no existing primary or secondary dust control apparatus are totally effective in preventing the release of some dust from the machine 24 into the surrounding air. Obviously, however, the smaller the amount of dust which is released into the air from the machine 24, the less the amount of dust which must be dealt with in the room air.

Figure 3:
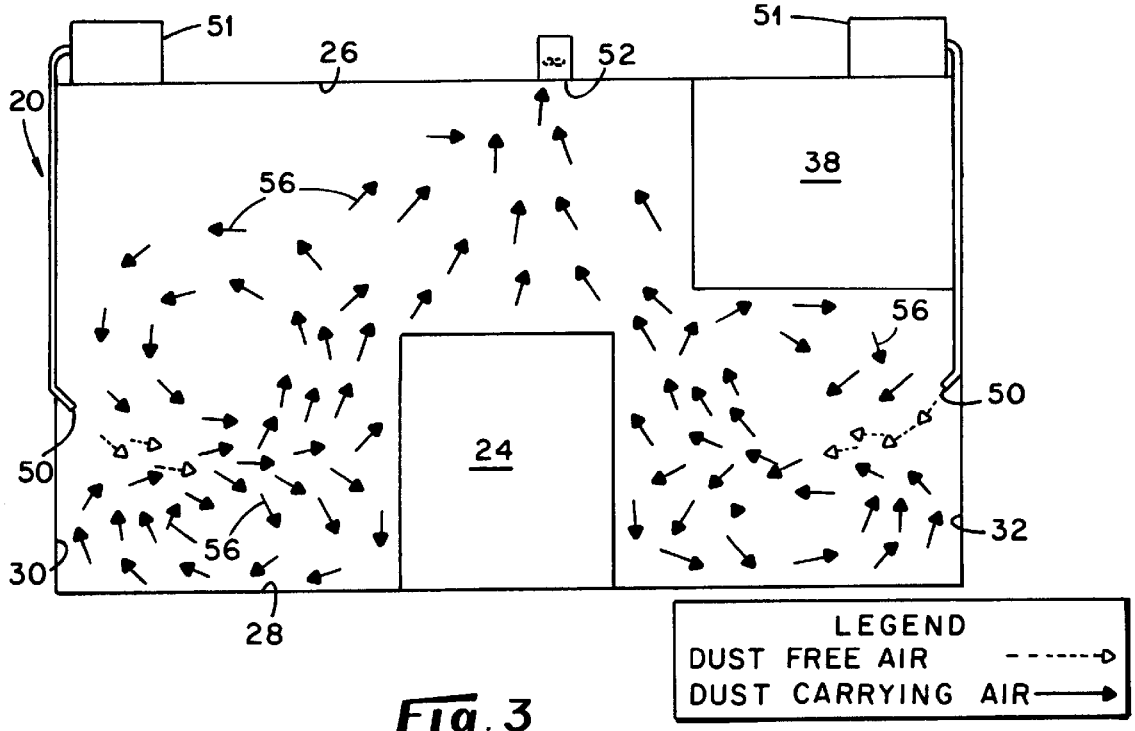
Fig. 3 PRIOR ART
FIG. 3 is a transverse cross section of the FIG. 1 room depicting air flow patterns within the room when ventilated by a room-ventilation scheme of the prior art.

For purposes of comparison, there is shown in FIG. 3 a cross section of the room 20 which is being ventilated in accordance with a typical ventilation arrangement of the prior art. In this FIG. 3 arrangement, incoming (substantially dust-free) air is introduced toward the center of the room 20 at relatively high velocity through louvers 50 disposed along the sidewalls 30 and 32 (and spaced above the floor 28), and air is withdrawn from the room 24 by way of vents 52 mounted in the ceiling 26. The louvers 50 receive air blown downwardly thereto from air make-up units 51 (e.g. a heating and air-conditioning unit) mounted upon the roof of the plant. To this end, air is pulled from the outside air by the make-up units 51 and blown downwardly to the louvers 50 through appropriate ductwork mounted along the sidewalls 30 and 32. Typically, the incoming air blown into the room 20 through each louver 50 is directed therefrom along a single direction so that various regions of air within the room are entrained by the flow of incoming air, and this entrainment of air establishes uncontrolled reverse migration air flow patterns, shown (in this typical example) by the flow arrows 56 of FIG. 3. These uncontrolled air flow patterns result in a mass dilution of the incoming, fresh air with dust-laden air adjacent the tissue machine 24 so that there exists few, if any, regions of air within the room which is free from some degree of dust. Furthermore, it is highly likely that with this FIG. 3 ventilation scheme, some of the dust which is released into the air by the machine 24 can remain airborne for some time, resulting in relatively high machine room dust concentration. It follows therefore that with the FIG. 3 room-ventilation scheme, the likelihood is high that dust-laden air will be pushed into the areas of the room where it could be breathed by operators or settle as dust upon various surfaces within the room.

Figure 4:
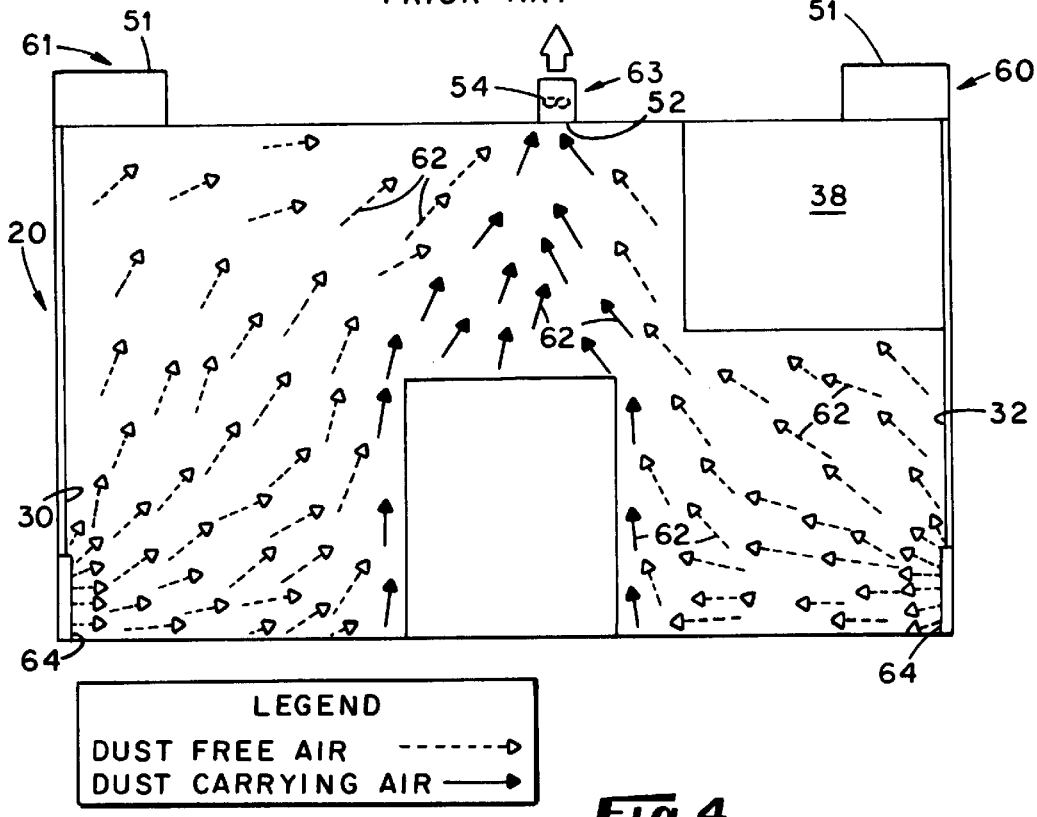
FIG. 4 is view similar to that of FIG. 3 depicting air flow patterns within the room when ventilated by an embodiment of a room-ventilation system in accordance with the present invention.

By comparison, there is shown in FIG. 4 a cross section of the room 20 depicting the flow of air currents therein when the room 20 is ventilated with an embodiment of a tertiary dust control system, generally indicated 60, of the present invention. To this end, the system 60 includes means, generally indicated 61 for introducing fresh, substantially dust-free air into the room in a flow pattern which prevents air from moving generally from the center of the room (i.e. at the location of the machine 24) toward the sidewalls 30, 32 and also includes means, generally indicated 63, for withdrawing air from the room at ceiling locations generally above the machine 24. The introducing means 61 includes air make-up units 51, as described above, for forcing fresh air (which may be filtered or unfiltered) downwardly through ductwork provided along the sidewalls 30, 32 and a plurality of displacement modules 64, described herein, through which the fresh air is discharged into the room. To this end, air is pulled from the outside air by the units 51 and directed through replaceable filter packs, if necessary, before being introduced into the room as fresh, substantially dust-free air. The withdrawing means 63 of the depicted system 60 includes a motor-driven fan 54 (which may be a vane-axial or a centrifugal fan) mounted in a ceiling vent 52 disposed generally above the machine 24. When actuated, the fan 54 pulls air upwardly through the vents 52 for discharge into the surrounding atmosphere. It will be understood, however, that in accordance with the broad aspects of the present invention, a gravity vent (which utilizes the convective forces induced by the papermaking process), an ejector or the equivalent can be substituted for the fan 54.

Within the FIG. 4 view, flow patterns of air moving through the room 20 are indicated with the air flow arrows 62. As evidenced by the pattern of the air flow arrows 62, incoming air which enters the room 20 at locations along the room walls travels a generally direct, rather than circuitous, path so that dust-carrying air is moved (i.e. pushed) toward the discharge vents 52 ahead of the incoming air and is prevented from re-entraining within the introduced fresh air. Thus, the air flow patterns established by the air moving through the room 20 displaces the dust-carrying air with fresh, relatively dust-free air and eliminates any likelihood that the incoming air will mix with the dust-carrying air in a manner which could contaminate any or all of the regions of the room air with migrant dust. In other words, the air flow patterns induced by the system 60 establishes a moving wall of ventilation air through the room 20 which results in a controlled air migration pattern throughout the room 20 which moves migrant dust directly toward the vents 52. Furthermore, the established air migration patterns effectively contain the dust-carrying air adjacent the machine 24 in a relatively narrow zone which surrounds the machine 24 and extends upwardly from the floor 28 to the vents 52. Therefore, dust-carrying air adjacent the machine 24 is prevented from migrating from the machine 24 and toward the room walls where it could be continually re-circulated throughout the room 24.

To effect the air flow patterns depicted in FIG. 4, the system 60 includes a plurality of inlet displacement modules 64, introduced above, disposed in relatively close proximity to one another along each wall of the room for directing air supplied from the air make-up units 51 into the room 20. Each of these displacement modules 64 can be relatively large and, by way of example, can be about ten feet in height (as measured from the floor 28) and twenty-two feet in length (as measured along the wall 30 or 32). In one embodiment of a displacement module, indicated 64A in FIG. 5, the module 64A is box-like in shape and is adapted to rest upon the floor 28 adjacent a corresponding sidewall 30 or 32. In addition, the module 64A has an exposed, vertically-oriented side 66 extending upwardly from the floor 28 and a rounded cap portion 68 attached to the upper end of the vertically-oriented side 66. In an alternative embodiment of a displacement module, indicated 64B in FIG. 6, the module 64B is relatively box-like in shape and is integrated within a corresponding sidewall 30 or 32 of the room 20 so that only a vertically-oriented side 70 is exposed to the room interior.

Figure 5:
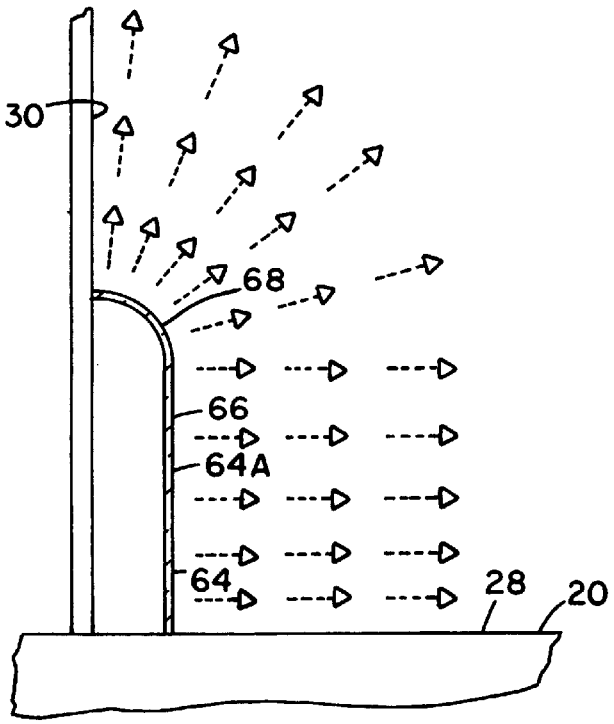
FIG. 5 is a elevational cross section of one embodiment of a displacement module capable of use in the FIG. 4 system.
Figure 6:
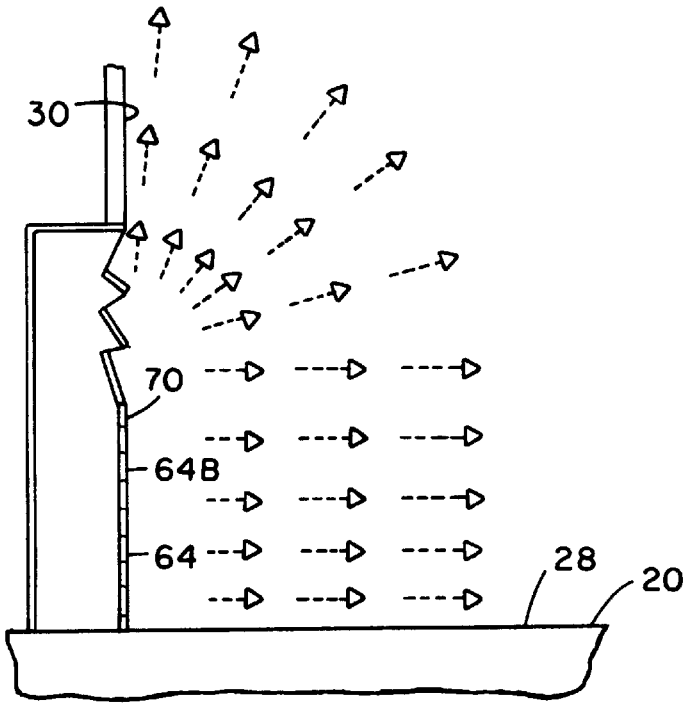
FIG. 6 is a view similar to that of FIG. 5 of an alternative embodiment of a displacement module capable of use in the FIG. 4 system.

Each of the FIG. 5 module 64A or the FIG. 6 module 64B is provided with an internal air-distribution plenum which effects an equal pressure distribution over the outlet of the module and also includes an air distributing device at the outlet through which the air is discharged into the room. The air distributing device at the module outlet includes a series of nozzle-like openings which direct air out of the module 64A or 64B in splayed pattern as shown in each of FIGS. 5 and 6 which fans outwardly from a corresponding sidewall 30 along a vertical plane which extends from the floor 28 to the corresponding sidewall 30 or 32. Therefore, the air emitted from a module 64A or 64B creates a moving wall of air which prevents the dust-carrying air in the room 20 from moving toward the room wall along a reverse migration path and consequently prevents a re-circulation of dust-carrying air disposed adjacent the machine 24 throughout the entirety of the room 20.

A displacement module such as the aforedescribed displacement module 62 is distinguishable from discharge vents of prior art room-ventilation systems which are typically supplied with louvers and grills disposed over the outlets of the vents because unlike the air discharged from the aforedescribed discharge modules 64, the air discharged through the louvers and grills of the prior art vents does not create a moving wall of air for preventing a mixing of dust-laden air with fresh air or for preventing a re-circulation of dust-laden air throughout the room. Hence, these prior art systems operate on a so-called "dilution ventilation" principle.

Figure 7:
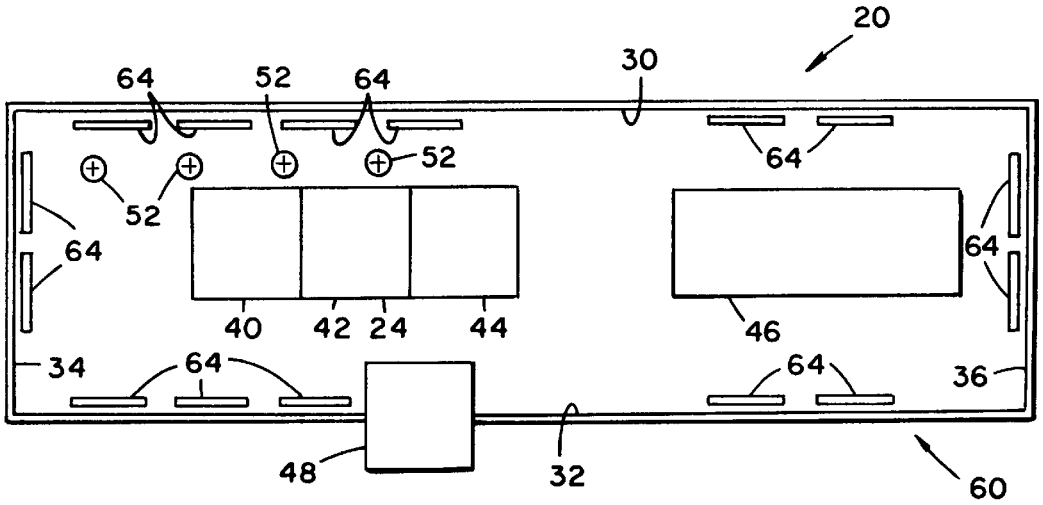
FIG. 7 is a plan view of the FIG. 1 room depicting an exemplary layout of the displacement modules of FIG. 5 when positioned along the perimeter of the room and the disposition of discharge vents located in the ceiling of the room.

As best shown in the room layout of FIG. 7, the displacement modules 64 are positioned in relatively close proximity to one another along the perimeter of the room 20 (i.e. along the room sidewalls and endwalls) while allowing sufficient spacing therebetween to accommodate doors permitting access to the room 20 and removal of product from the room 20.

With reference still to FIG. 7, the ceiling vents 52 are each circular in form and are arranged relatively close together in a line extending along the ceiling 26. When operating, the fan 54 (FIG. 4) associated with each vent 52 pulls air upwardly through the vent 52 from the room 20 and into the surrounding environment. It is preferable that the vents 52 be disposed as directly above the machine 24 as is possible for air flow balance considerations (discussed herein), but safety considerations normally prevent the positioning of a machine directly beneath fan-including vents. Therefore, in a room within the system 60 is employed, the ceiling vents 52 will normally be disposed at positions along the ceiling 26 which are slightly offset to one side of locations disposed directly above the machine 24. Accordingly and as used herein, the phrase "generally above" the machine 24 is intended to include those locations which are slightly offset from the ceiling locations disposed directly above the machine 24.

The introduction of air into and withdrawal of air from the room 20 is coordinated so that the dust-carrying air which surrounds the machine 24 converges toward the center thereof where it is carried generally upwardly toward the ceiling vents 52 and, in accordance with the air flow arrows 62 of FIG. 4, it is displaced by the air which is introduced into the room 20 through the displacement modules 64. Accordingly, the amount of air which is introduced into the room 20 along the room walls is appropriately balanced so that the air converges toward the vertical centerline of the machine 24. For example, in the FIG. 7 layout of the room 20 wherein the machine 24 is positioned closer to the sidewall 30 than to the sidewall 32, an exemplary flow rate of air introduced along the sidewall 32 can be in the range of between 100 and 150 feet per minute while the flow rate of air introduced along the sidewall 30 can be about 75 feet per minute and the flow rate of air introduced along the endwalls 34 and 36 can be about 100 feet per minute as measured at a location disposed about ten feet in height from the operating floor 28 and about ten feet away from the corresponding sidewall 30 or 32.

As mentioned earlier, vapor and heat is released into the room 20 from the machine 24 and creates natural forces of air movement within the room which aid the movement of dust-carrying air upwardly toward the ceiling vents 52. More specifically, the vapor and heat which is released from the machine 24 induce convective currents in the vicinity of the machine 24 which move the air generally upwardly toward the ceiling 26 of the room 20, and this natural upward-movement of the room air enables the power and volume requirements of the air make-up units 51 and the vent fans 54 to be reduced in order to fully displace the dust-carrying air within the room 20 with the introduced fresh air.

While the air flow patterns developed within the room 20 are suitable for displacing the dust-carrying air surrounding the machine 24 with incoming, fresh air so that the concentration of dust in the workspaces or operator sites adjacent the machine 24 are relatively low, lower dust concentration levels are achieved when the emission of dust from the papermaking equipment, such as the reel section 44, is reduced during equipment operation and when primary and secondary dust controls, as described above, are used in conjunction with the system 60 for reducing the amount of dust which is ultimately released into the surrounding air.

Figure 8:
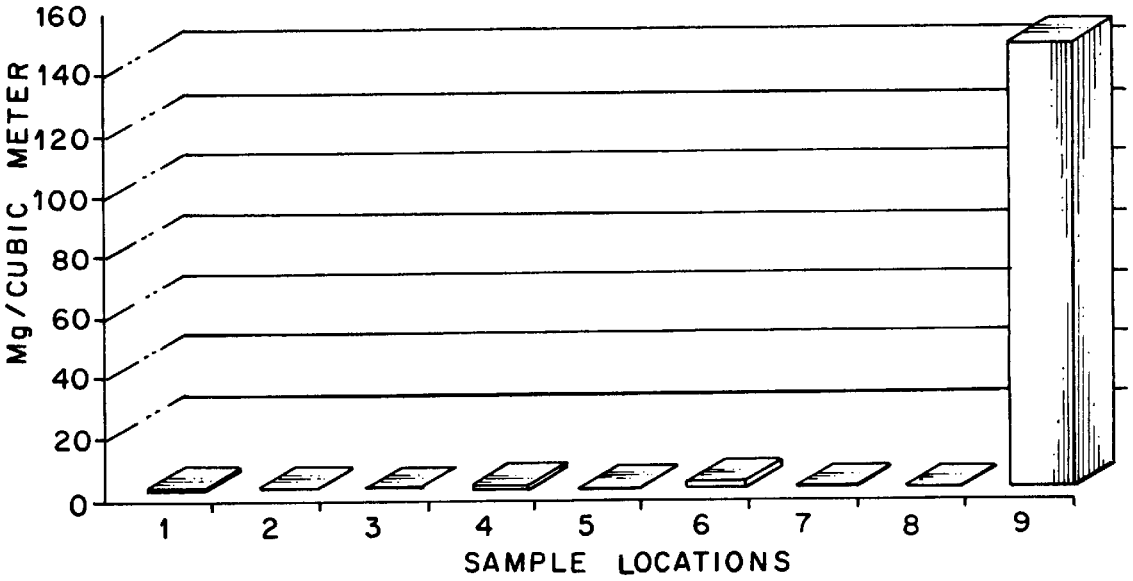
FIG. 8 is a graph illustrating the dust concentration level measurements made at various locations in the FIG. 1 within which the FIG. 4 system is utilized.
Figure 9:
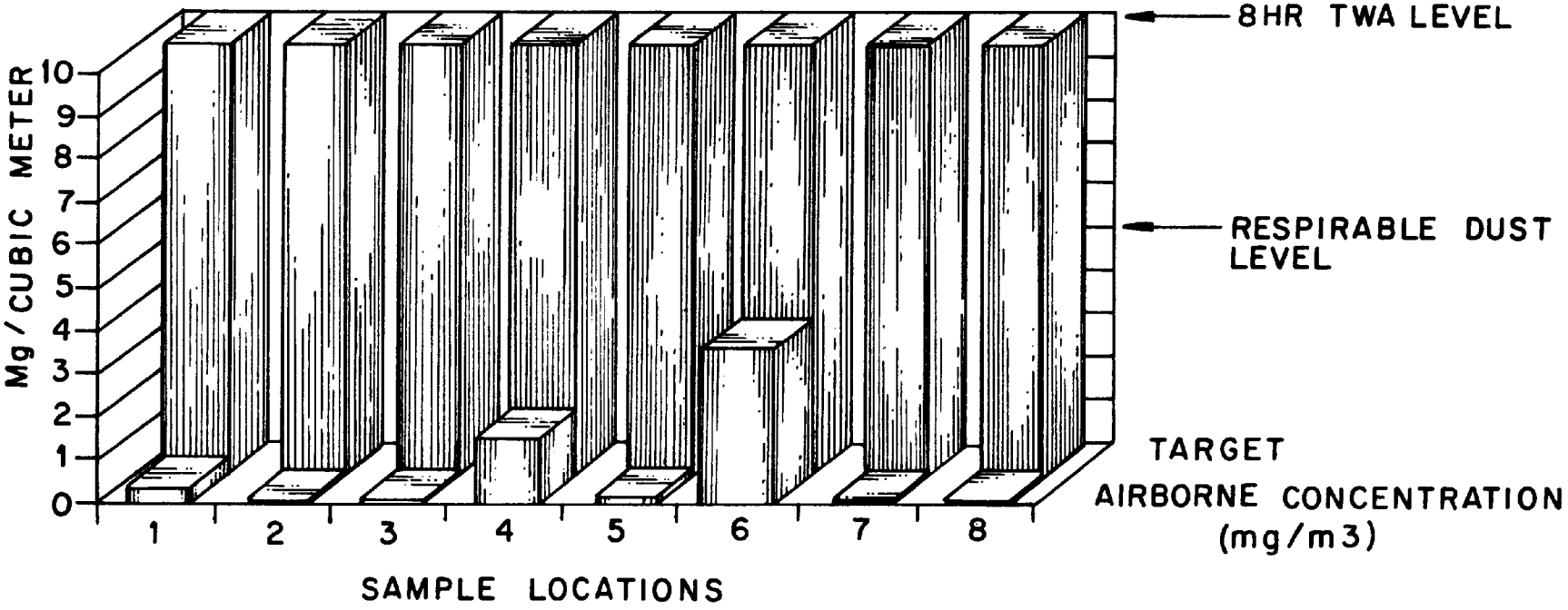
FIG. 9 is a portion of the graph of FIG. 8 drawn to a larger scale.

By way of example, dust concentration levels in a tissue machine room 20 measuring roughly about 250 feet in length, 150 feet in length and 60 feet in height within which a tissue machine 24 is housed and within which primary and secondary dust control schemes, as well as the tertiary system 60, are employed have been measured at the locations designated 1–9 in FIG. 2 and are tabulated in FIGS. 8 and 9. Whereas current U.S. regulations require that the respirable dust levels at exemplary worker sites within the room, such as for example stations 1–8, be ten $mg/m^3$ or less (based on an eight-hour time-weighted average), it can be seen from the FIG. 8 test results that the requirements of current U.S. regulations are easily met. (The same data taken at the locations designated 1–8 have been tabulated in FIG. 9 alongside the target, or upper, dust concentration level of ten $mg/m^3$ to provide a better idea of how low the measured concentration levels are to the target concentration level of ten $mg/m^3$ and to a respirable dust limit of five $mg/m^3$.) Moreover, the measurements taken at station 9 (i.e. 146 $mg/m^3$) and depicted in FIG. 8 provides an indication of just how well the primary and secondary dust control systems and the tertiary dust control system 60 collectively operate to prevent any appreciable dust from contaminating the respirable air to which operators are likely to be exposed. In other words, since station 9 has been described as a site on the machine 24 at which the release of dust is likely to be the greatest, the measurement obtained at station 9 provides an indication of the potential amount of dust which, if not for the dust control systems attending the machine 24, could be released into the respirable air surrounding the machine 24. The existence of such a large difference between the measurement taken at station 9 and those taken at stations 1–8 provides evidence of the collective effectiveness of the dust control systems attending the machine 24.

Because a papermaking process is known to release a relatively large amount of heat and humidity-generating vapors into a machine room, a principle purpose served by room ventilation systems is to control the temperature and environmental conditions which could otherwise adversely affect the comfort of operators attending the papermaking process. With this in mind, it should be appreciated that the aforementioned system is advantageous for its capability to control the temperature and humidity of the room as well as the concentration levels of dust in the room. To this end, the moving wall of fresh air which is introduced into the room 20 by way of the displacement modules 64 pushes the heat and humidity-generating vapors upwardly toward the ceiling vents 52 for discharge from the room 20 with the dust-carrying air. Therefore, as is the dust-carrying air, the heat and vapor which is released into the room air by the papermaking machine 24 is prevented from circulating (and building up) throughout the room by the flow patterns of the fresh air introduced into the room 20. Consequently, the system 20 prevents released heat and vapors from appreciably affecting the comfort-related conditions of the room and is further advantageous in this respect.

It follows from the foregoing that a process and system have been described involving the simultaneous introduction of fresh air into and withdrawal of air from the room in a manner which displaces the dust-carrying air of the room with fresh air. By coordinating the introduction of air with the withdrawal of fresh air, air currents are established between the displacement modules 64 and the ceiling vents 52 which prevent a reverse migration of dust-carrying air from the areas surrounding the machine 24 toward the sidewalls. Consequently, the process and system 60 described herein moves the dust-carrying air along a continuous path generally upwardly toward the ceiling vents 52 and prevents dust-carrying air surrounding the machine 24 from mixing with the air in a manner which would otherwise permit a recirculation (and consequential accumulation) of dust-carrying air throughout the room interior.

It will be understood that numerous modifications and substitutions can be had to the aforedescribed embodiment without departing from the spirit of the invention. Accordingly, the aforedescribed embodiments are intended for the purpose of illustration and not as limitation.

We claim:

1. A process for ventilating a room bounded by walls, a ceiling and a floor and wherein a dust-releasing source is positioned substantially centrally of the floor of the room and the air which surrounds the dust-releasing source carries dust released therefrom, the process comprising the steps of:

introducing fresh, substantially dust-free air into the room through locations along the walls thereof so that the introduced fresh air is directed generally away from the wall locations in a splayed, fan-like flow pattern as viewed from one side thereof wherein the fan-like flow pattern has two opposite edges and fans away from each wall location so that the opposite edges of the fan-like air flow pattern extend respectively along the floor and the corresponding wall along which the fresh air is introduced and thereby prevents dust-carrying air situated adjacent the dust-releasing source from moving generally from the center of the room and toward the wall locations;

withdrawing air from the room through the ceiling at locations therein disposed generally above the dust-releasing source; and coordinating the introduction of the fresh air into the room and the withdrawal of air from the room to create a moving wall of ventilation air which moves from the wall locations through which fresh air is introduced into the room to the ceiling locations through which the air is withdrawn from the room so that substantially all of the dust-carrying air situated adjacent the dust-releasing source is prevented from circulating through the room by the moving wall of ventilation air and is instead moved by the introduced fresh air generally upwardly toward the ceiling locations through which the air is withdrawn from the room and is substantially displaced within the room by the introduced fresh air.

2. The process as defined in claim 1 wherein the steps of introducing and withdrawing create an air flow pattern through the room which prevents the dilution of the introduced air by the dust-carrying air in a manner which would otherwise re-circulate dust-carrying air throughout the room.

3. The process as defined in claim 1 wherein the step of introducing is preceded by a step of mounting inlet displacement modules at the wall locations through which fresh air is introduced into the room, and the pattern of fresh air introduced into the room during the introducing step is established by the inlet displacement modules.

4. A process for ventilating a room bounded by walls, a ceiling and a floor and wherein a dust-releasing source is positioned substantially centrally of the floor of the room, the process comprising the steps of:

withdrawing air from the room through the ceiling at locations therein disposed generally above the dust-releasing source;

introducing fresh, substantially dust-free air into the room through locations adjacent the room walls in a splayed, fan-like flow pattern as viewed from one side thereof wherein the fan-like pattern has two opposite edges and fans away from each wall location so that the opposite edges of the fan-like flow pattern extend respectively along the floor and the corresponding wall through which the fresh air is introduced so that substantially all of the dust-carrying air situated adjacent the dust-releasing source is prevented from becoming mixed with the introduced fresh air and from moving generally toward the locations through which the fresh air is introduced and instead is moved generally upwardly by the introduced fresh air toward the ceiling locations through which air is withdrawn from the room; and coordinating the steps of withdrawing and introducing to create a moving wall of ventilation air which moves from the wall locations through which fresh air is introduced into the room to the ceiling locations through which air is withdrawn from the room so that the introduced fresh air substantially displaces the dust-carrying air which surrounds the dust-releasing source.

5. A process for ventilating a papermaking machine room bounded by side and end walls, a ceiling and a floor and wherein a papermaking machine is positioned substantially centrally of the floor of the room and releases dust into the air surrounding the papermaking machine so that the air which surrounds the papermaking machine carries dust released thereby, the process comprising the steps of:

introducing fresh, substantially dust-free air into the machine room through inlet displacement modules disposed along the walls of the room so that air which is introduced into the room through the inlet displacement modules is directed therefrom in a splayed, fan-like pattern as viewed from a side thereof wherein the fan-like pattern has two opposite edges and fans away from each displacement module so that the opposite edges of the fan-like flow pattern extend respectively along the floor and the corresponding wall along with the displacement module is dispersed, and which fan-like flow pattern of introduced air generally prevents dust-carrying air which surrounds the papermaking machine from mixing with the introduced fresh air and from moving from the center of the room and toward the inlet displacement modules;

withdrawing air from the room through vents in the ceiling wherein the ceiling vents are disposed at locations in the ceiling which are generally above the papermaking machine; and coordinating the steps of introducing and withdrawing to create a moving wall of ventilation air which moves from the displacement modules through which air is introduced into the room to the ceiling vents through which air is withdrawn from the room so that dust-carrying air which surrounds the papermaking machine is pushed ahead of the introduced fresh air and generally toward the ceiling vents for withdrawal from the room.

6. The process as defined in claim 5 wherein the steps of introducing and withdrawing create an air flow pattern through the room which prevents the dilution of the introduced air by the dust-carrying air in a manner which would otherwise re-circulate dust-carrying air throughout the room.

7. The process as defined in claim 5 wherein the steps of introducing and withdrawing effect a confining of dust-carrying air disposed about the papermaking machine to a zone which envelopes the dust-releasing source and extends from the floor to the ceiling vents.

8. A system for ventilating a room bounded by walls, a ceiling and a floor and wherein a dust-releasing source is positioned substantially centrally of the floor of the room so that air which surrounds the dust-releasing source carries dust released by the dust-releasing source, the system comprising:

means for introducing fresh, substantially dust-free air into the room through inlet locations situated adjacent the room walls so that air which is introduced through said inlet locations is directed away therefrom in a splayed, fan-like flow pattern as viewed from one side thereof wherein the fan-like flow pattern has two opposite edges and fans away from each inlet location so that the opposite edges of the fan-like flow pattern extend respectively along the floor and the corresponding wall adjacent which the inlet location is situated so that the fan-like flow pattern generally prevents air adjacent the dust-releasing source from becoming mixed with the introduced fresh air and from moving from the center of the room toward said inlet locations; and means for withdrawing air from the room through the ceiling by way of vents provided therein at locations disposed generally above the dust-releasing source; and wherein the introducing means and withdrawing means are coordinated with one another to create a moving wall of ventilation air which moves from the inlet locations through which fresh air is introduced into the room to the ceiling vents through which the air is withdrawn from the room so that substantially all of the dust-carrying air which surrounds the dust-releasing source is moved generally upwardly through the room by the created moving wall of ventilation air toward the ceiling vents by the introduced fresh air and is substantially displaced in the room by the introduced fresh air.

9. The system as defined in claim 8 wherein the means for introducing includes a plurality of inlet displacement modules disposed adjacent the walls and floor of the room wherein each displacement includes an outlet provided with openings which collectively direct air outwardly therefrom in the splayed, fan-like pattern.

10. The system as defined in claim 8 wherein the dust-releasing source employs at least one of a primary or secondary dust control apparatus for collecting dust at or near the source of dust release so that the dust which is released into the air of the room is the dust which is not collected by said at least one of a primary or secondary dust control apparatus.

11. The system as defined in claim 8 wherein the dust-releasing source is a papermaking machine, and the room within which the papermaking machine is housed is a papermaking machine room.

* * * * *